US008387280B2

(12) United States Patent
Grote et al.

(10) Patent No.: US 8,387,280 B2
(45) Date of Patent: Mar. 5, 2013

(54) MECHANICAL CUSHIONING SYSTEM FOR FOOTWEAR

(75) Inventors: Paul S. Grote, Cincinnati, OH (US); Patrick Y. Choe, Somerville, MA (US); Sean Murphy, North Andover, MA (US)

(73) Assignee: New Balance Athletic Shoe, Inc., Boston, MA (US)

( * ) Notice: Subject to any disclaimer, the term of this patent is extended or adjusted under 35 U.S.C. 154(b) by 590 days.

(21) Appl. No.: 12/590,050

(22) Filed: Nov. 2, 2009

(65) Prior Publication Data

US 2010/0126040 A1 May 27, 2010

Related U.S. Application Data

(63) Continuation-in-part of application No. 29/312,462, filed on Oct. 22, 2008, now Pat. No. Des. 615,286.

(51) Int. Cl.
*A43B 13/18* (2006.01)

(52) U.S. Cl. ..... 36/28; 36/27

(58) Field of Classification Search ..... 36/28, 27, 36/25 R, 30 R, 32 R, 35 R
See application file for complete search history.

(56) References Cited

U.S. PATENT DOCUMENTS

| | | | | | |
|---|---|---|---|---|---|
| 4,638,577 | A * | 1/1987 | Riggs | 36/114 |
| 5,060,401 | A * | 10/1991 | Whatley | 36/25 R |
| 5,279,051 | A * | 1/1994 | Whatley | 36/25 R |
| 5,822,886 | A * | 10/1998 | Luthi et al. | 36/28 |
| 6,769,202 | B1 * | 8/2004 | Luthi et al. | 36/28 |
| D532,598 | S * | 11/2006 | Chan | D2/977 |
| D560,903 | S * | 2/2008 | Chan | D2/977 |
| 7,383,647 | B2 * | 6/2008 | Chan et al. | 36/28 |
| 2006/0201028 | A1 * | 9/2006 | Chan et al. | 36/28 |

* cited by examiner

*Primary Examiner* — Ted Kavanaugh
(74) *Attorney, Agent, or Firm* — New Balance Athletic Shoe, Inc.

(57) ABSTRACT

A midsole element is adapted for positioning on a medial or lateral side of a shoe. The midsole element, having a longitudinal direction and a transverse direction, includes a top portion, a bottom portion, and a compression element, which has at least two first strut members and at least two second strut members disposed between the top and bottom portions and supporting the top portion a distance away from the bottom portion. The at least two first strut members being separated by a first longitudinal distance in the longitudinal direction. The at least two second strut members being separated by a second longitudinal distance in the longitudinal direction and each of said first and second transversely disposed two strut members are oriented and adapted to preferentially deflect in the same direction in response to a force imparted on the midsole element.

16 Claims, 11 Drawing Sheets

MECHANICAL CUSHIONING SYSTEM FOR FOOTWEAR

CROSS-REFERENCE TO RELATED APPLICATIONS

This patent application is a continuation-in-part of and claims priority to co-pending U.S. patent application Ser. No. 29/312,462, entitled "Portion of a Shoe Sole," filed Oct. 22, 2008, the entirety of which is incorporated herein by reference.

FIELD OF THE INVENTION

Embodiments of the present invention relate to an athletic shoe sole having a mechanical cushioning system which can be easily customized for specific applications by slightly modifying the shoe sole's configuration.

BACKGROUND OF THE INVENTION

Footwear, in particular athletic footwear, are expected to provide proper shock absorption and stability thereby preventing potential harmful effects of vigorous movements such as running and jumping on the wearer's feet. The footwear industry has been developing athletic shoes in an effort to maximize shock absorption and stability while also maximizing comfort and durability. Unfortunately, these goals are potentially in conflict with each other. For example, a shoe that provides adequate shock absorption and comfort may not provide sufficient stability. To further advance the development of athletic shoes, a basic understanding of the dynamics of running and the mechanisms of running injuries is important.

A typical walking or running gait cycle involves two phases: (1) a stance phase, and (2) a swing phase. One foot contacts the support surface such as the ground and bears weight in the stance phase while the other foot is moving through the air and advances in the swing phase. The two phases are repetitive. The difference between the running and walking gait cycles is that at one point during the running cycle the person is airborne without bearing any weight, whereas the walking cycle does not include such an airborne moment.

The stance phase of a running gait cycle may be further divided into three periods: (1) the loading period, also called "the impact and support period" or "the heel strike period," (2) the mid-stance period, also called "the mid-stance and propulsion period," and (3) the toe-off period, also called "the recovery period." For a typical runner of a heel-to-toe running style, the loading period begins with a first contact of the heel with the running surface, followed by a controlled lowering of the forefoot to the running surface. The first contact of the heel typically occurs at the rear, outer part of the heel. The mid-stance period begins once the forefoot is in contact with the running surface. During the mid-stance period, the contraction of the musculature of the leg generates power to propel the body forward. The heel progressively lifts and the forefoot flexes at the metatarsophalangeal joint. Then in the toe-off period, the foot disengages contact with the running surface and the foot becomes airborne.

Pronation is a normal movement of the foot that occurs during the loading and mid-stance periods of the stance phase of the gait cycle. At heel strike during the loading period, the heel of the foot is supinated and makes initial contact with the running surface as described earlier. Instantaneously, the joint between the foot bones called the subtalar joint is unlocked, allowing pronation, a coordinated triplane motion of the foot, to occur during the forefoot lowering events of the loading period of the stance phase. The coordinated triplane motion of the foot involves three planes of motion: (1) abduction, in which the front of the foot is turned outwards and away from the line of progression of the runner; (2) dorsiflexion, in which the front of the foot is angled upwards relative to the heel of the foot; and (3) eversion, in which the sole of the foot is turned outward relative to the heel of the foot. With the combination of these three motions, the foot rolls from the outside or lateral side to the inside or medial side of the foot resulting in the medial aspect (the arch area) of the foot coming into contact with the running surface, thus allowing the foot to adapt to the running surface and to transfer some of the loading force to the running surface, thereby reducing the risk of injury during the stance phase of running. The pronated position of the foot is maintained throughout the mid-stance period.

Supination typically follows pronation. As the body moves forward over the foot, the subtalar joint locks. This allows a reversal of the events that have occurred during the loading period to occur during the mid-stance period. Supination is a coordinated triplane motion of the foot, which involves three planes of motion: (1) adduction, in which the locking of the subtalar joint allows the foot to turn inward toward the line of progression; (2) plantarflex, in which the forefoot is flexed downward relative to the heel; and (3) inversion, in which the sole of the foot is turned inward relative to the heel. With the combination of these three motions, the foot continues rolling forward onto the toes. During motion through ball and toe contact, the foot rolls outward just before the toes starts to leave the ground. The combination of these motions allows the foot to be converted from a mobile adaptor to a rigid lever, which is essential for the forward propulsion of the body. The foot remains supinated while it is off the ground between steps.

Although pronation is a natural action and is considered an important and healthy response to the intense amount of shock imposed upon the foot, excessive pronation and high pronation velocity have been suggested by biomechanists to cause a variety of injuries at the ankle, knee and hip among runners and other athletes. Many prior art soles have been designed to control pronation and supination. However, as the stability of the sole increases to control the amount of lateral motion of a foot in order to prevent excessive pronation, the shock absorption properties for reducing the impact of strike forces on the foot usually decrease. Thus, the footwear industry continues to seek a proper balance between the stability and shock absorption properties in designing shoe soles.

For Example, U.S. Pat. No. 5,625,964, issued to Lyden et al., discloses an athletic shoe having a sole with a rearfoot strike zone segmented from the remaining heel area by a line of flexion which permits articulation of the strike zone during initial heel strike of a runner. The line of flexion is located to delimit a rearfoot strike zone reflecting the heel to toe running style of the majority of the running population. In addition to allowing articulation of the rearfoot strike zone about the line of flexion, the sole incorporates cushioning elements, including a resilient gas filled bladder, to provide differential cushioning characteristics in different parts of the heel, to attenuate force applications and shock associated with heel strike, without degrading footwear stability during subsequent phases of the running cycle. The line of flexion may be formed by various ways including a deep groove, a line of relatively flexible midsole material, and a relatively flexible portion of a segmented fluid bladder.

Our prior patent, U.S. Pat. No. 7,383,647 (hereinafter "our prior patent"), which is incorporated by reference as though fully set forth herein, discloses a midsole for footwear comprising a medial element, which comprises a top plate, a bottom plate, and a plurality of strut members disposed between the top and bottom plates for supporting the top plate a distance away from the bottom plate. Adjacent strut members have a C shaped cross-section facing in the same direction. The midsole element may further comprise a heel cleft to increase the flexibility of the sole. In a preferred embodiment, the strut members on the medial side are arranged at an angle to the strut members on the lateral side of the sole. The directional design provides flexibility and stiffness anisotropically to the sole in the longitudinal and lateral directions of the sole respectively. In one embodiment, the midsole strut element on the medial side and the lateral strut element of the midsole element on the lateral side are integrally molded. In another embodiment, the medial and lateral top portions, medial and lateral shut members and medial and lateral bottom portions are independently selected from the following materials: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide, engineered polyester, TPU blends including natural and synthetic rubbers, and blends or combinations thereof. In yet another embodiment, at least two adjacent medial struts are oriented at a first angle relative to a longitudinal direction of an article of footwear to define a medial stiffening axis, the at least two adjacent medial struts oriented and adapted to preferentially deflect in the same direction transversely to a medial stiffening direction in response to a force imparted on the medial element of the article of footwear during use. One of the at least two adjacent medial struts adapted to preferentially deflect in said same direction toward the other of said at least two adjacent medial strut members, thereby providing directional flexibility transverse to said medial stiffening axis.

The midsole disclosed in our prior patent may also include a lateral element comprising: a top lateral portion; a bottom lateral portion and a plurality of lateral strut members disposed between said top and bottom lateral portions for supporting said top lateral portion a distance away from said bottom lateral portion; wherein at least two adjacent lateral strut members are oriented at a second angle relative to the longitudinal axis of said article of footwear to define a lateral stiffening axis, said at least two adjacent lateral strut members oriented and adapted to preferentially deflect in the same direction transversely to said lateral stiffening axis in response to a force imparted on said lateral element of said article of footwear during use, one of said at least two adjacent lateral strut members adapted to preferentially deflect in said same direction toward the other of said at least two adjacent lateral strut members, thereby providing directional flexibility transverse to said lateral stiffening axis; wherein said lateral stiffening axis is arranged at an angle to said medial stiffening axis, said at least two adjacent medial strut members and said at least two adjacent lateral strut members adapted and arranged to provide flexibility and stiffness anisotropically to said midsole.

SUMMARY OF THE INVENTION

In accordance with this invention there is provided a midsole element adapted for positioning on a medial or lateral side of a shoe, the midsole element has a longitudinal direction and a transverse direction. The midsole element includes a top portion, a bottom portion, and a compression element, which has at least two first strut members disposed between the top and bottom portions and supporting the top portion a distance away from the bottom portion. There is also at least two second strut members disposed between the top and bottom portions transversely disposed from the first strut members and also supporting the top portion the distance away from said bottom portion. The at least two first strut members being separated by a first longitudinal distance in the longitudinal direction. The at least two second strut members being separated by a second longitudinal distance in the longitudinal direction and each of said first and second transversely disposed two strut members are oriented and adapted to preferentially deflect in the same direction in response to a force imparted on the midsole element.

The midsole element can have the first and second longitudinal distances the same or different. If the first longitudinal distance are different one can be an integer multiple of the second other.

In some embodiments the second strut members are adapted to provide less resistance to compression in response to a wearer's foot striking the ground than the first strut members do.

In some of the midsole elements each of the top portion, the bottom portion, the first strut member, and the second strut member is independently selected from a group consisting of the following materials: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide, engineered polyester, TPU blends including natural and synthetic rubbers, and blends or combinations thereof

DETAILED DESCRIPTION OF THE INVENTION

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

Figure 1:
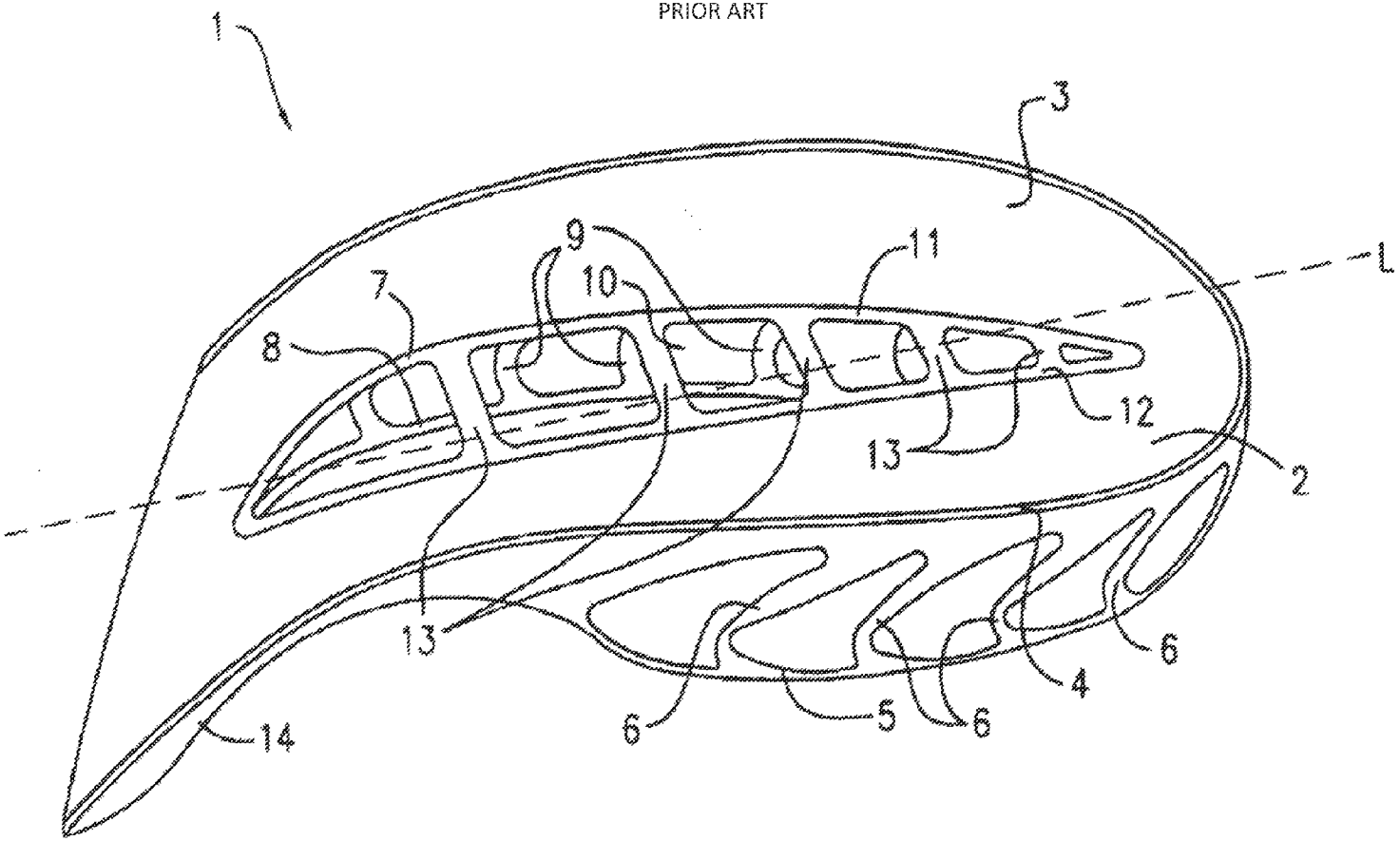
PRIOR ART FIG. 1
FIG. 1 is a perspective view of a midsole element disclosed in our prior patent.

The present invention has a common theme with the subject matter of our prior patent so the general outline of that theme will be discussed with respect to FIG. 1. FIG. 1 illustrates an exemplary embodiment of a midsole element in accordance with one aspect of our prior patent. The midsole element 1 comprises: a medial element 2 and a lateral element 3. The medial element comprises a top medial plate 4, a bottom medial plate 5, and a plurality of medial strut members 6 disposed between the top and bottom medial plates 4, 5 for supporting the top medial plate 4 a distance away from the bottom medial plate 5. The lateral element 3 comprises a top lateral plate 7, a bottom lateral plate 8, and a plurality of lateral strut members 9 disposed between the top and bottom lateral plates 7, 8 for supporting the top lateral plate 7 a distance away from the bottom lateral plate 8. The directional design provides flexibility and stiffness anisotropically to the sole in the longitudinal and lateral directions of the shoe respectively.

Figure 2:
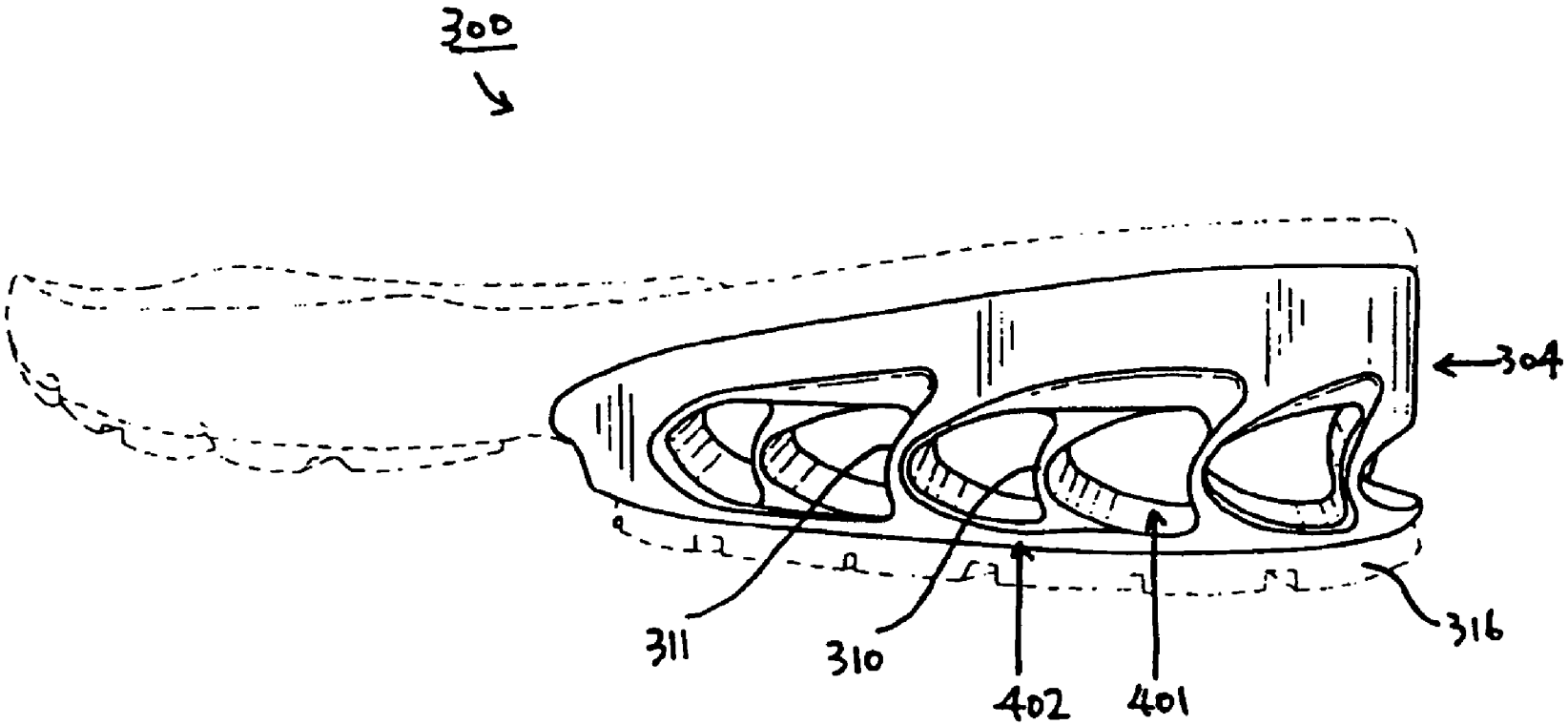
FIG. 2 is a rear-side perspective view of a sole according to an embodiment of the lateral midsole element of this invention.

FIG. 2 is a rear-side perspective view of a sole 300 which has a lateral midsole element 304 constructed in accordance with this invention. The lateral midsole element 304 comprises a first strut portion 401 and a second strut portion 402 which are disposed transversely adjacent to each other. The first strut portion 401 comprises a first set of strut members 310, while the second strut portion 402 comprises a second set of strut members 311. In both sets, each strut member is preferably C-shaped with the C's facing the same direction and deflectable in response to vertical compressions, as described above.

The struts in the second strut portion 402 may be made of a different material and/or have a distinctively different color as compared to the struts in the first strut portion 401. For structural stability, the base portions towards either end of each C-shaped strut member (where the strut member connects with the top and bottom plates of the strut portion) may be substantially wider than the center portion of the strut member. The strut members within either set are disposed longitudinally adjacent to one another. That is, each set of strut members are generally and approximately lined up in the longitudinal direction of the sole 300. Two longitudinally adjacent strut members therefore form an opening between them which runs approximately in the traverse direction tunneling through the lateral midsole element 304.

Each of the first and second strut portions 401 and 402, as well as the top and bottom portions of the lateral midsole element 304, may be made of a material independently selected from the following group: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide, engineered polyester, TPU blends including natural and synthetic rubbers, and blends or combinations thereof.

Each of the two strut portions 401 and 402, and their two respective sets of strut members 310 and 311 in particular, may be separately manufactured but coordinately configured to create a desired stiffness profile for the lateral midsole element 304. Alternatively, the two strut portions 401 and 402 may be manufactured together, such as being molded in substantially one piece, wherein each strut portion can still have a different configuration than the other. Configuration of either strut portion may involve adjusting one or more parameters of its strut members, including but not limited to the hardness, shape, thickness, depth, spacing, and orientation of the strut members.

For example, the second (or outer) strut portion 402 may in general be adapted to provide less resistance to compression in response to a wearer's foot striking ground than the first (or inner) strut portion 401. Accordingly, the spacing between two adjacent strut members 311 in the second strut portion 402 may be wider than the spacing between two adjacent strut members 310 in the first strut portion 401. According to one particular embodiment, the strut spacing in the strut portion 402 may be approximately twice the corresponding spacing in the strut portion 401. It should be noted that the reference to strut spacing does not suggest that the strut members in either strut portion have to be evenly spaced. In fact, the embodiment shown in FIG. 2 illustrates unevenly spaced strut members in both sets. Furthermore, the height and spacing of the strut members 310 and 311 may progressively change with the slope of the heel portion of the sole 300.

The relative position or alignment of the second strut portion 402 with respect to the first strut portion 401 is also a variable that can be adjusted. In the embodiment shown in FIG. 2, the strut members 311 in part of the strut portion 402 are aligned with every other strut member 310 in part of the strut portion 401. It should be noted, however, that alignment of the strut members 311 with the strut members 310 is not strictly required.

The depth of a strut portion or strut member is the width of that element measured generally in the transverse direction of the sole 300. The depth of the strut portion 402 may be substantially smaller than the depth of the strut portion 401. According to one particular embodiment, the depth of the strut portion 402 may be comparable to that of the strut portion 401 at the rear end of the heel portion and may gradually decrease towards the front end, such that the strut portion 402 appears like a vertical "layer" of strut members that wraps around the rear and lateral sides of the strut portion 401.

According to some embodiments of the present invention, when assembling footwear items that incorporate midsole elements with multiple strut portions as described herein, one may achieve desired stiffness profiles by choosing from pre-manufactured strut portions and/or midsole elements of varying configurations.

In an alternative embodiment, the strut portions 401 and 402 are made of substantially the same type of material and may also be of a same or similar color. Since it is mostly exposed on the lateral and rear side of the heel portion, the strut portion 402, whether made of a same or different material as the strut portion 401, may further incorporate reflective substance (e.g., embedded light-reflecting particles) to enhance visibility of the footwear in a dark environment.

Figure 3:
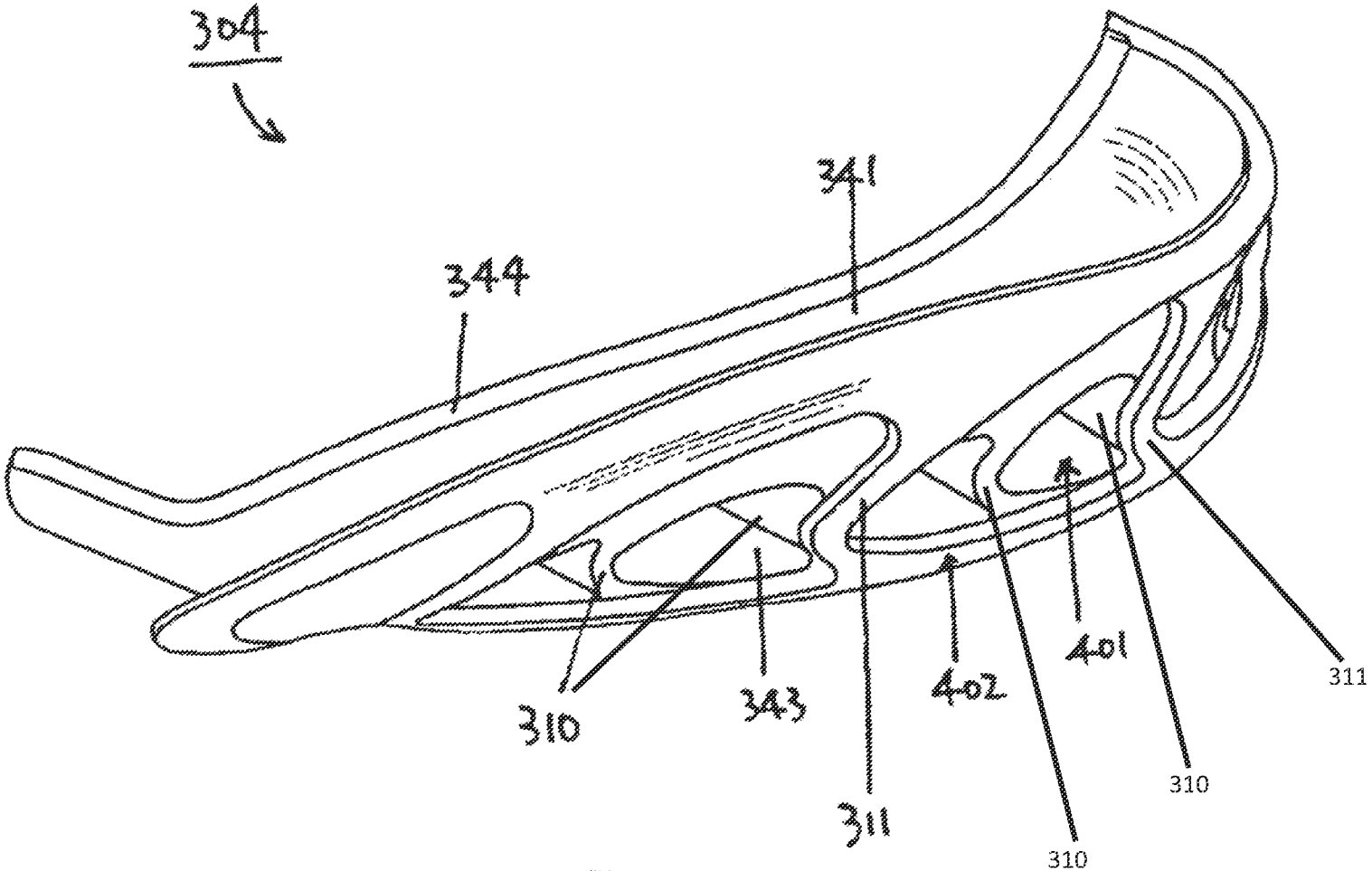
FIG. 3 is a perspective view of the exemplary lateral midsole element.

FIG. 3 is a perspective view of the lateral midsole element 304. The lateral midsole element 304 comprises a first strut portion 401 and a second strut portion 402. The strut portion 402 may have a smaller depth than the first strut portion 401 and appears to be a layer wrapped around the strut portion 401 on its lateral and rear sides. The top plate 341 is on the foot-facing side and may curve up along the lateral and rear edges to accommodate the shape of a wearer's lateral heel portion. The bottom plate 343 may be substantially flat on the ground-facing side such that a traction pad (not shown) can be attached. On the medial side, the top plate 341 may have a recessed edge 344 for receiving a correspondingly extruded edge of another midsole element, as will be described in further detail below.

Figure 4:
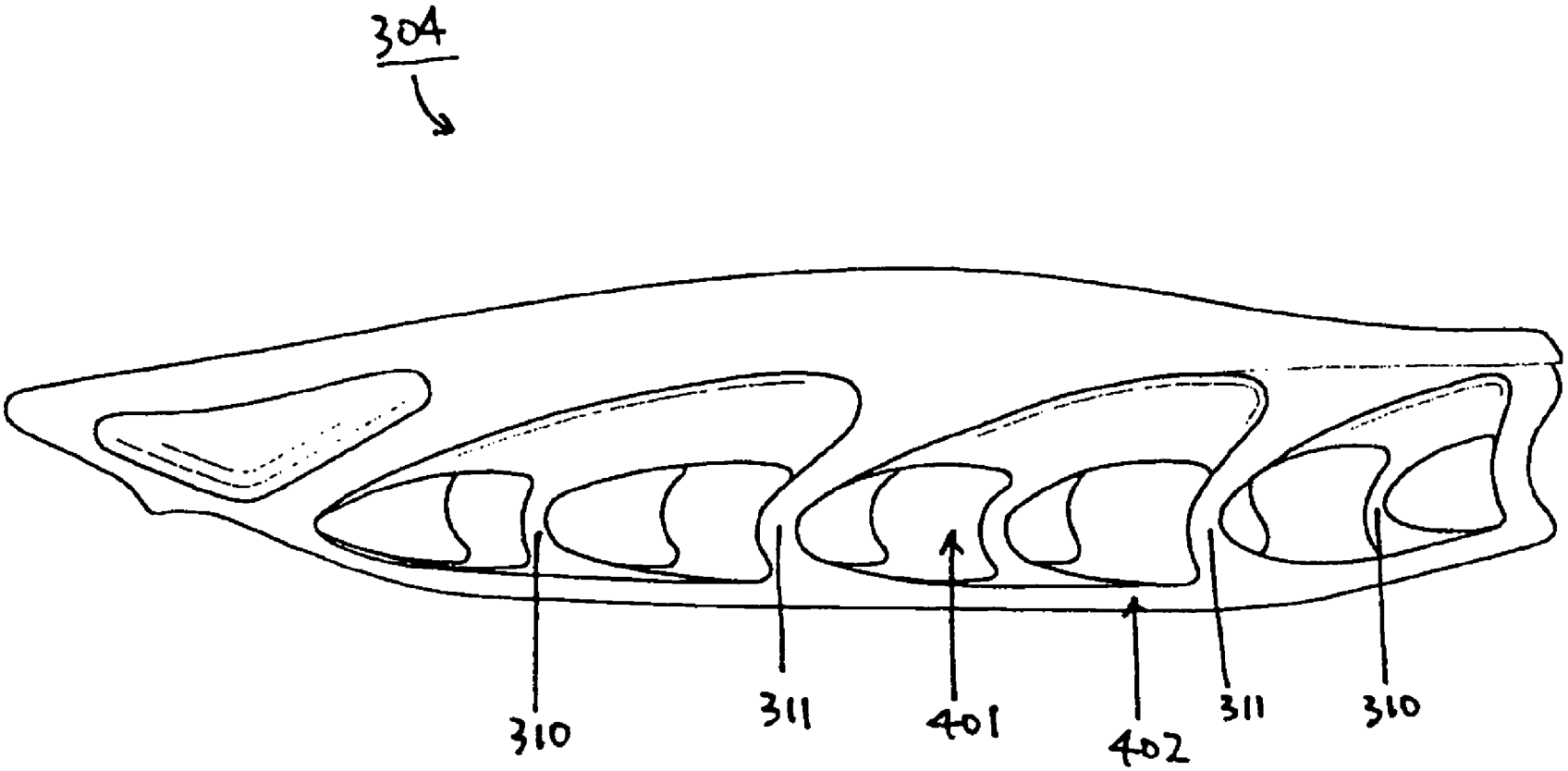
FIG. 4 is a lateral side view of the lateral midsole element.
Figure 5:
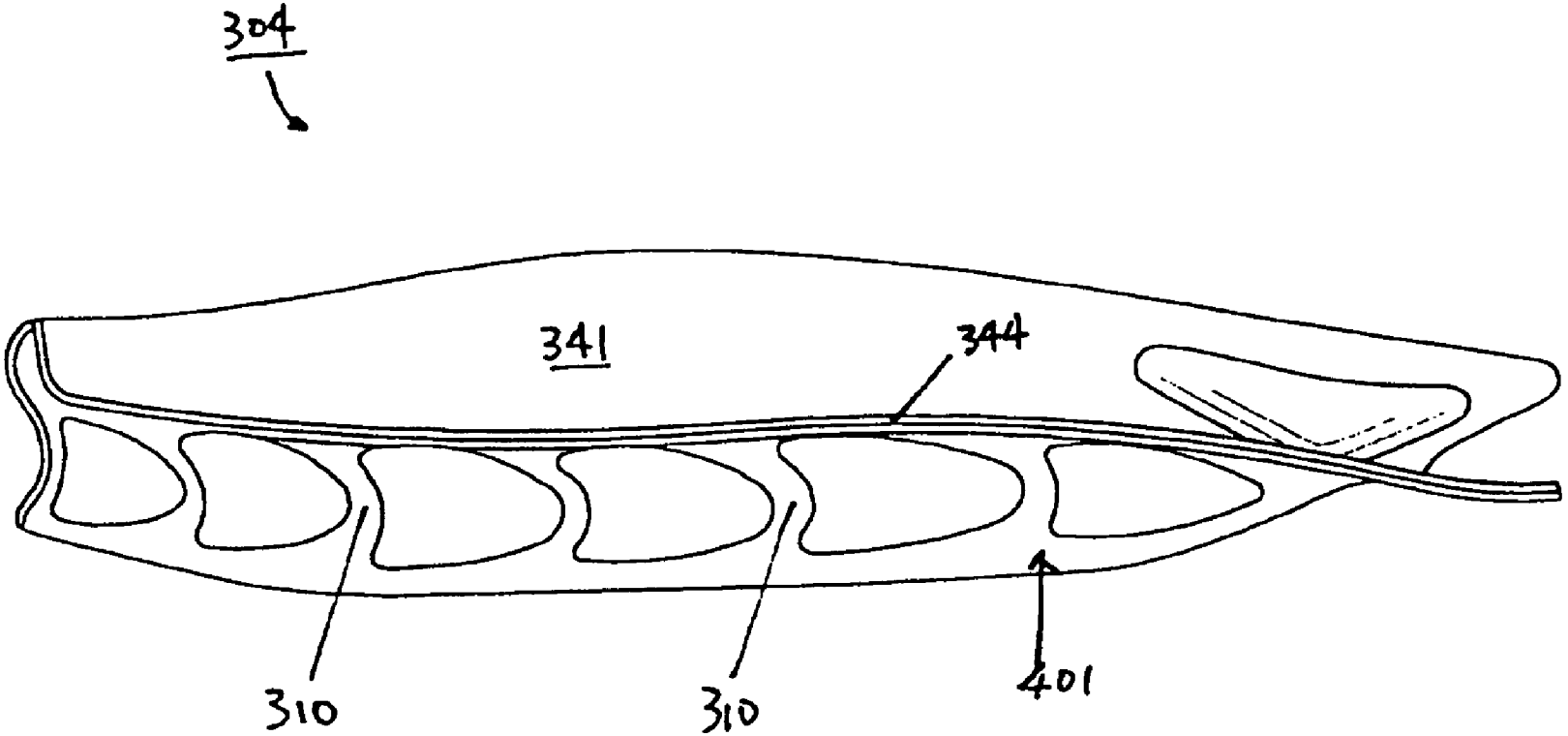
FIG. 5 is a medial side view of the lateral midsole element.

FIG. 4 is a lateral side view of the lateral midsole element 304. In this embodiment shown, there are two strut members 310 in the strut portion 401 for every one strut member 311 in the strut portion 402. The strut members 311 are aligned with every other strut member 310. FIG. 5 shows a medial side view of the lateral midsole element 304.

Figure 6:
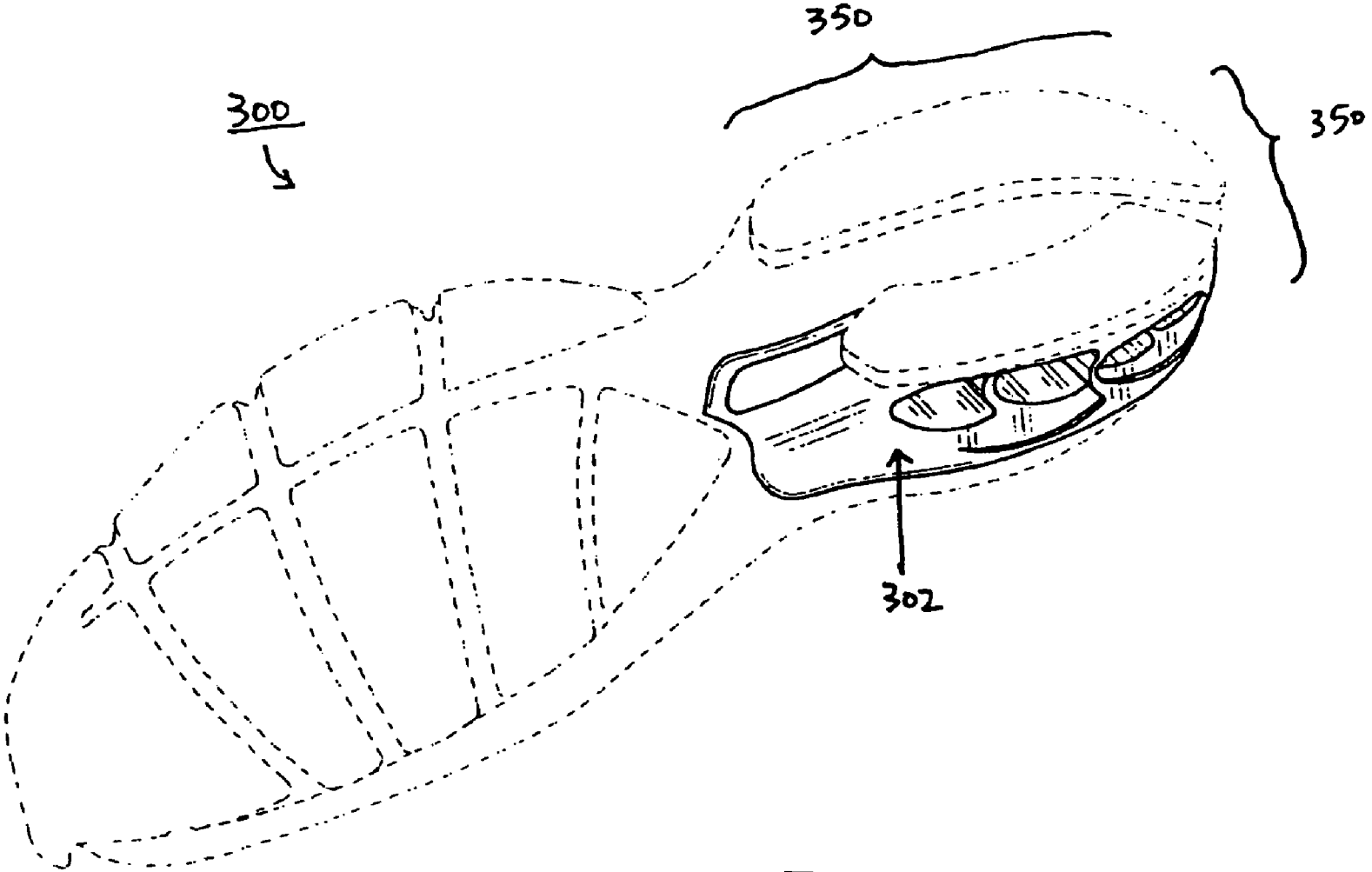
FIG. 6 is a bottom-side perspective view of the sole highlighting an exemplary medial midsole element in accordance with an embodiment of the present invention.
Figure 7:
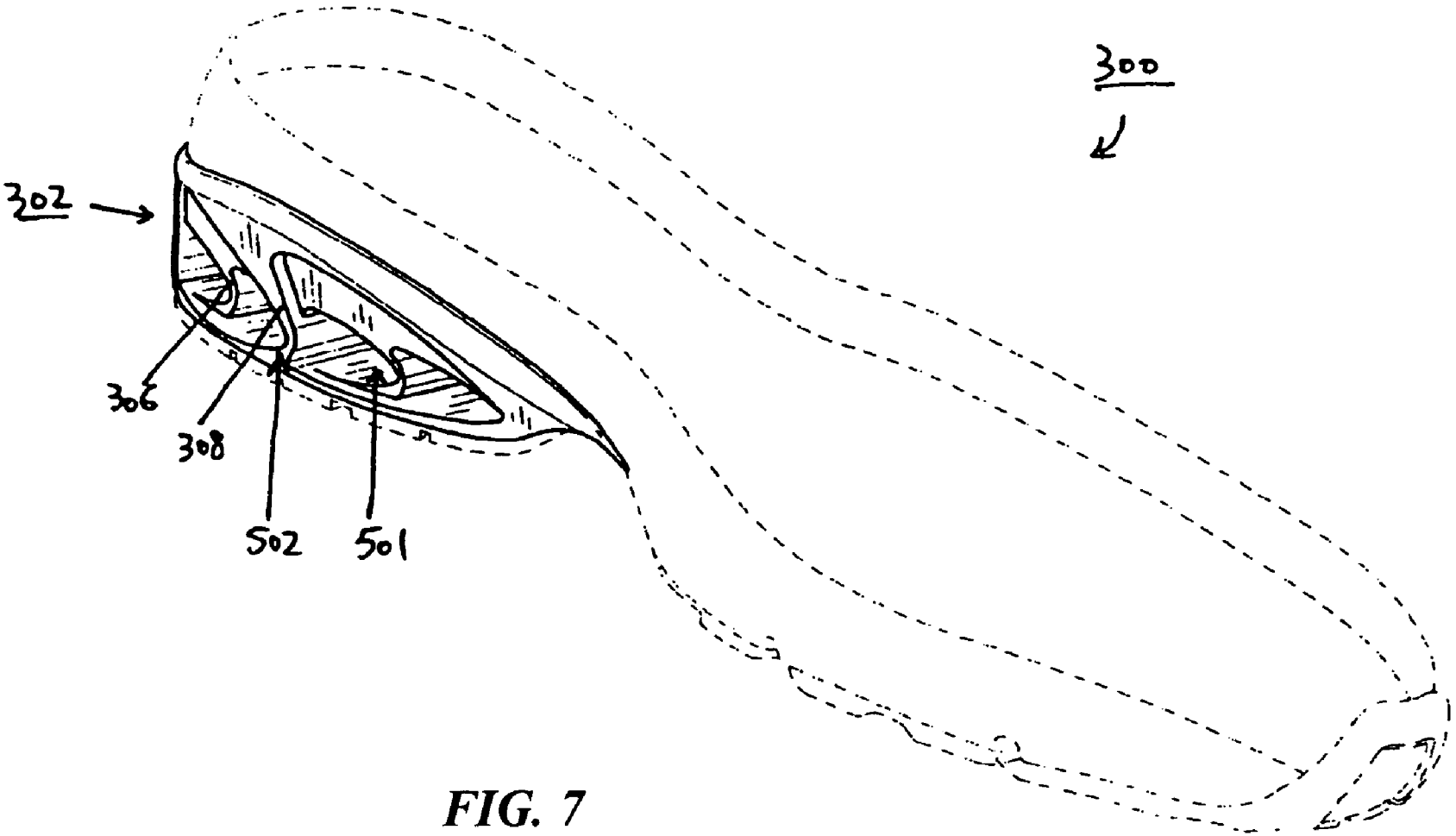
FIG. 7 is a top-side perspective view of the sole highlighting the exemplary medial midsole element.
Figure 8:
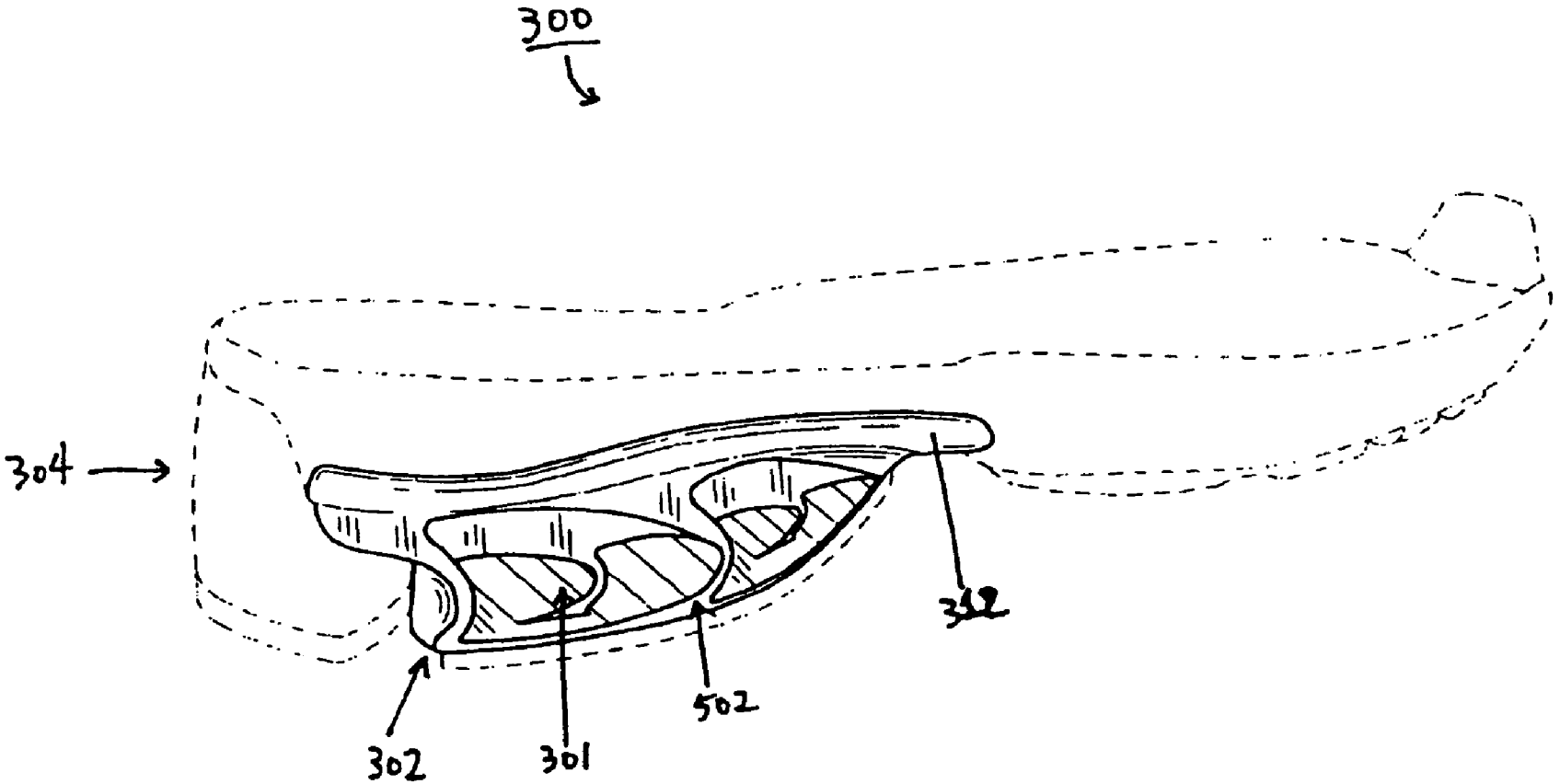
FIG. 8 is a rear-side perspective view of the sole highlighting the medial midsole element.

FIG. 6 shows a bottom-side perspective view of the sole 300 highlighting an exemplary medial midsole element 302 in accordance with an embodiment of the present invention. FIG. 8 is a top-side perspective view of the sole 300 highlighting the exemplary medial midsole element 302. In this exemplary embodiment of the present invention, the midsole element 302 comprises a first (outer) strut portion 501 and a second (inner) strut portion 502 which are disposed transversely adjacent to each other. The strut portion 502 is disposed medial to the strut portion 501. The strut portion 501 comprises strut members 306 disposed between a top portion and a bottom portion. Similarly, the strut portion 502 comprises strut member(s) 308. The strut portions 501 and 502 may be manufactured separately or in one integral piece, and they may be made of the same or different materials. The embodiment of the midsole element 302 shown in FIG. 8 has been molded in a single piece. Both sets of strut members 306 and 308 may be configurable to achieve a desired stiffness profile for the midsole element 302. For example, the strut portion 502 may be adapted to be less resistant to compression forces than the strut portion 501.

The relative stiffness of the midsole elements 302 and 304 may also be adjusted. According to one embodiment of the present invention, the medial midsole element 302 may be configured to be stiffer and therefore provide more support than the lateral midsole element 304. Alternatively, the lateral midsole element 304 may be made stiffer than the medial midsole element 302.

FIG. 8 shows a rear-side perspective view of the sole 300 highlighting the medial midsole element 302.

Figure 9:
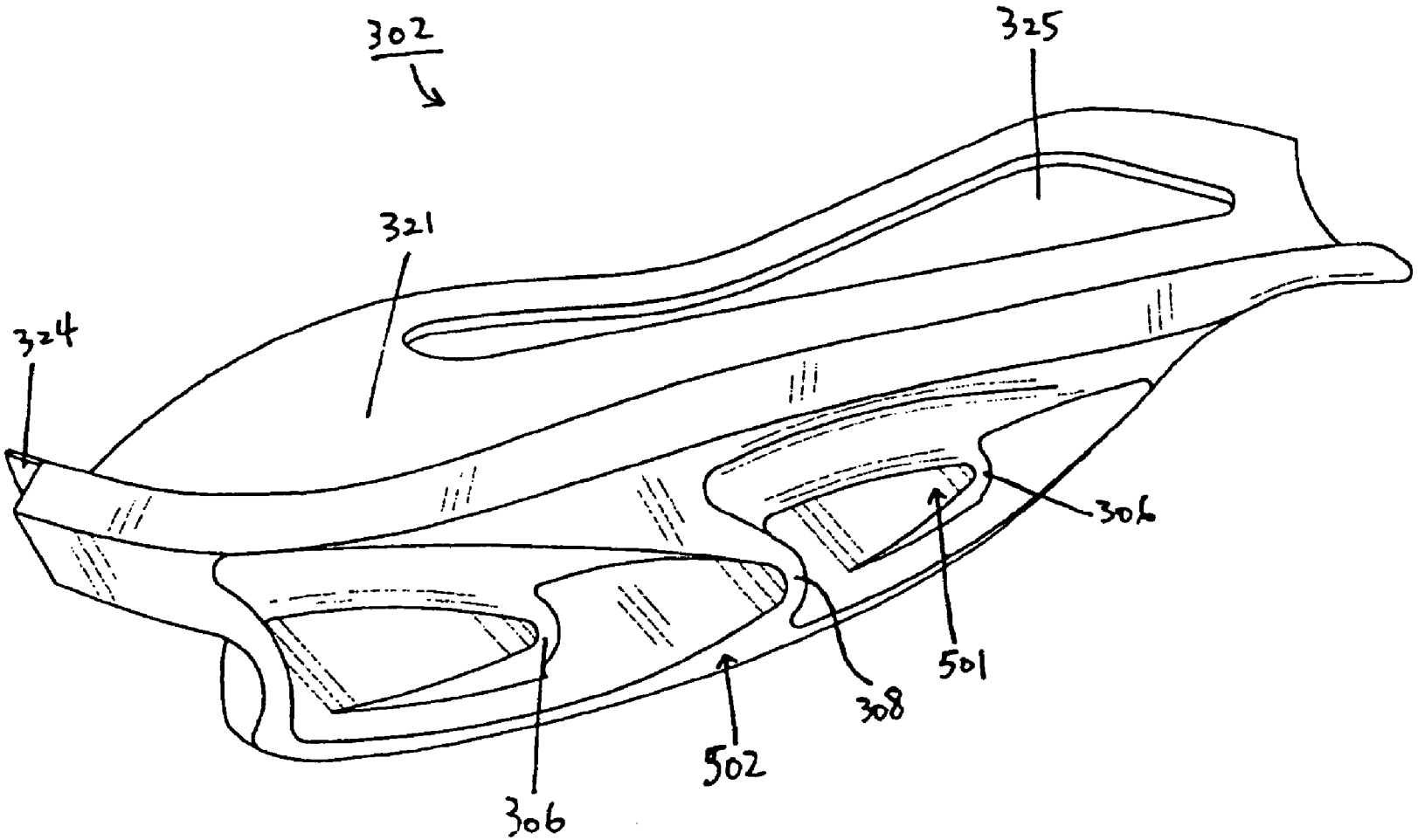
FIG. 9 is a perspective view of the exemplary medial midsole element.

FIG. 9 is a perspective view of an exemplary medial midsole element 302 in a standalone state. The medial midsole element 302 comprises a first strut portion 501 and a second strut portion 502. The strut portion 502 may have a smaller depth than the first strut portion 501 and appears to be a layer that wraps around the strut portion 501 on its medial and rear sides. The top plate 321 is on the foot-facing side and may curve up along the medial and rear edges to accommodate the shape of a wearer's medial heel portion. The bottom plate 323 may be substantially flat on the ground-facing side such that a traction pad can be easily attached. On the lateral side, the top plate 321 may have an extruded edge 324 that matches or fits the recessed edge 344 of the lateral midsole element 304 as shown in FIG. 3. In the top plate 321, there may be a cavity 325 which decouples the medial midsole element 302 from the lateral midsole element 304 and makes the assembled midsole flexible. The cavity 325 may also serve to reduce the weight of the midsole element 302.

Figure 10:
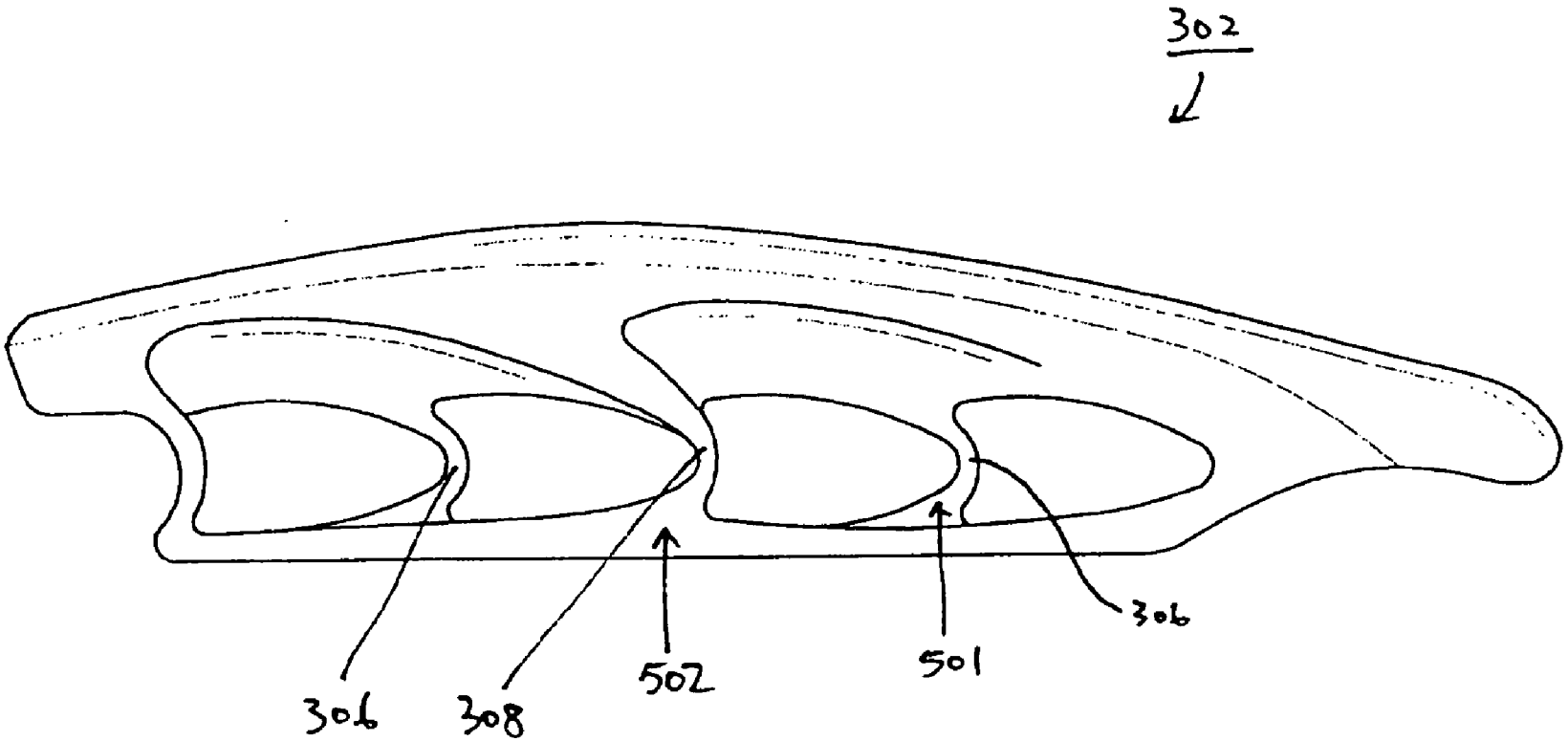
FIG. 10 is a medial side view of the medial midsole element.
Figure 11:
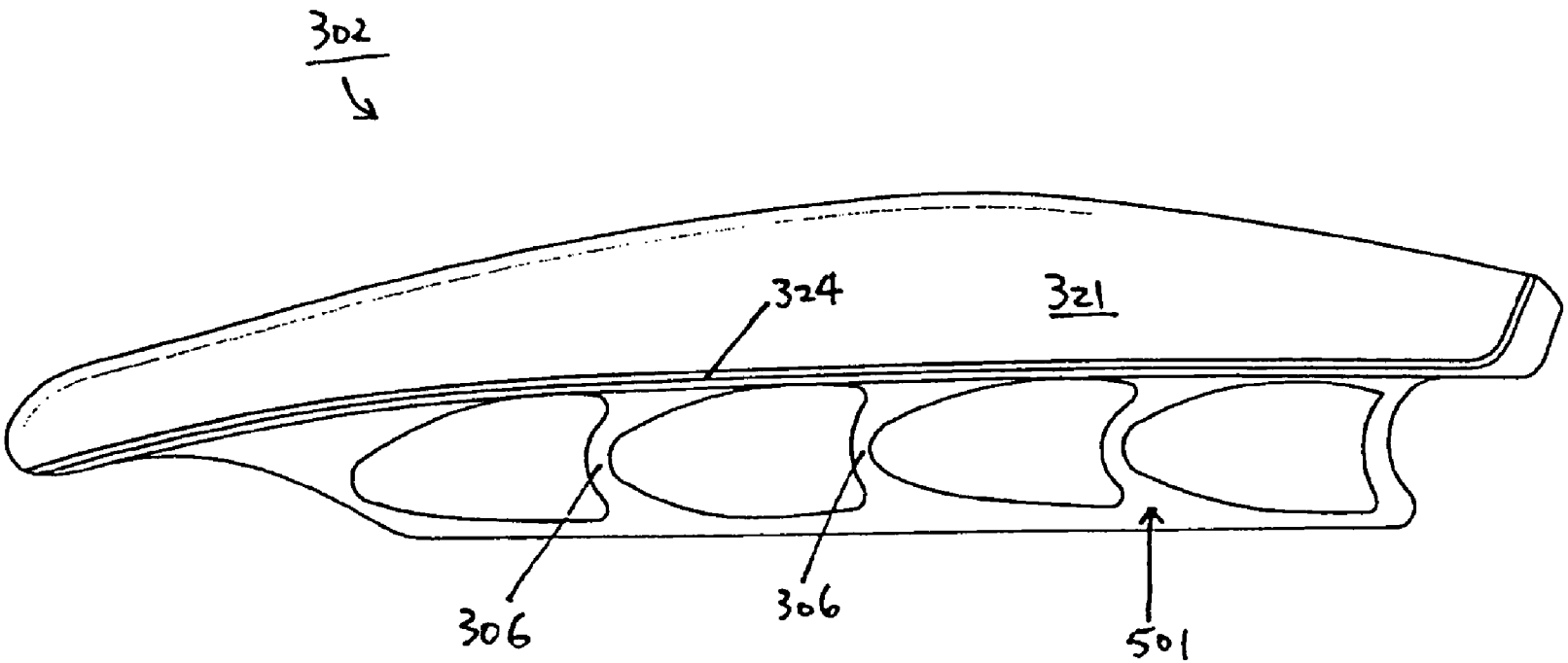
FIG. 11 is a lateral side view of the medial midsole element.

FIG. 10 is a medial side view of the medial midsole element 302. In this embodiment shown, there are two strut members 306 in the strut portion 501 for every one strut member 308 in the strut portion 502. The strut members 308 are aligned with every other strut member 306. FIG. 11 shows a lateral side view of the medial midsole element 302.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

What is claimed is:

1. A midsole element adapted for positioning on a lateral side of a shoe, said midsole element having a longitudinal direction and a transverse direction and comprising:

a top portion, a bottom portion, and a compression element adapted for positioning on a lateral side of a shoe, comprising:

at least two first inner strut members comprising a first material and first depth disposed between said top and bottom portions and supporting said top portion a distance away from said bottom portion, at least two second outer strut members comprising a second material different from said first material and a second depth different from said first depth disposed on an outer surface of said midsole element between said top and bottom portions transversely disposed from and abuttingly adjacent to said first strut members and also supporting said top portion said distance away from said bottom portion, said at least two first strut members being separated by a first longitudinal distance in said longitudinal direction, said at least two second strut members being separated by a second longitudinal distance in said longitudinal direction, each of said first and second transversely disposed two strut member are oriented and adapted to preferentially deflect in the same direction in response to a force imparted on said midsole element.

2. The midsole element as defined in claim 1 in which said first and second longitudinal distances are the same.

3. The midsole element as defined in claim 1 in which said first and second longitudinal distances are different.

4. The midsole element as defined in claim 3 in which said second longitudinal distance is an integer multiple of said first longitudinal distance.

5. The midsole element as defined in claim 1, wherein said top portion, said bottom portion, and said compression element constitute a lateral heel portion of a midsole.

6. The midsole element as defined in claim 1, wherein said second strut members are adapted to provide less resistance to compression in response to a wearer's foot striking the ground than said first strut members.

7. The midsole element as defined in claim 1, wherein said second longitudinal distance is approximately twice said first longitudinal distance.

8. The midsole element as defined in claim 1, wherein each of said top portion, said bottom portion, said first strut member, and said second strut member is independently selected from a group consisting of the following materials: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide, engineered polyester, TPU blends including natural and synthetic rubbers, and blends.

9. A midsole element adapted for positioning on a medial side of a shoe, said midsole element having a longitudinal direction and a transverse direction and comprising:

a top portion, a bottom portion, and a compression element adapted for positioning on a medial side of a shoe, comprising:

at least two first inner strut members comprising a first material and first depth disposed between said top and bottom portions and supporting said top portion a distance away from said bottom portion, at least two second outer strut members comprising a second material different from said first material and a second depth different from said first depth disposed on an outer surface of said midsole element between said top and bottom portions transversely disposed from and abuttingly adjacent to said first strut members and also supporting said top portion said distance away from said bottom portion, said at least two first strut members being separated by a first longitudinal distance in said longitudinal direction, said at least two second strut members being separated by a second longitudinal distance in said longitudinal direction, each of said first and second transversely disposed two strut member are oriented and adapted to preferentially deflect in the same direction in response to a force imparted on said midsole element.

10. The midsole element as defined in claim 9 in which said first and second longitudinal distances are the same.

11. The midsole element as defined in claim 9 in which said first and second longitudinal distances are different.

12. The midsole element as defined in claim 11 in which said second longitudinal distance is an integer multiple of said first longitudinal distance.

13. The midsole element as defined in claim 9, wherein said top portion, said bottom portion, and said compression element constitute a medial heel portion of a midsole.

14. The midsole element as defined in claim 9, wherein said second strut members are adapted to provide less resistance to compression in response to a wearer's foot striking the ground than said first strut members.

15. The midsole element as defined in claim 9, wherein said second longitudinal distance is approximately twice said first longitudinal distance.

16. The midsole element as defined in claim 9, wherein each of said top portion, said bottom portion, said first strut member, and said second strut member is independently selected from a group consisting of the following materials: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide, engineered polyester, TPU blends including natural and synthetic rubbers, and blends.

* * * * *